US009167324B2

(12) United States Patent
Yang

(10) Patent No.: US 9,167,324 B2
(45) Date of Patent: Oct. 20, 2015

(54) SPEAKER MODULE FOR PORTABLE TERMINAL

(71) Applicant: Samsung Electronics Co., Ltd., Gyeonggi-do (KR)

(72) Inventor: Hyun-Mo Yang, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 6 days.

(21) Appl. No.: 13/921,313

(22) Filed: Jun. 19, 2013

(65) Prior Publication Data

US 2014/0029783 A1 Jan. 30, 2014

(30) Foreign Application Priority Data

Jul. 30, 2012 (KR) ..... 10-2012-0083372

(51) Int. Cl.
*H04R 25/00* (2006.01)
*H04R 1/02* (2006.01)

(52) U.S. Cl.
CPC ..... *H04R 1/02* (2013.01); *H04R 1/021* (2013.01); *H04R 25/558* (2013.01)

(58) Field of Classification Search
CPC ..... H04R 25/558
USPC ..... 381/395, 386, 384, 189, 315, 323, 150, 381/367, 87, 332, 394, 334; 455/82, 90.3, 455/350, 347
See application file for complete search history.

(56) References Cited

U.S. PATENT DOCUMENTS

| | | | | |
|---|---|---|---|---|
| 6,526,150 | B2 | 2/2003 | Kelly et al. | |
| 6,785,395 | B1 * | 8/2004 | Arneson et al. | 381/334 |
| 7,043,042 | B2 * | 5/2006 | Huang et al. | 381/334 |
| 7,069,061 | B2 * | 6/2006 | Gammon et al. | 455/575.1 |
| 7,822,221 | B2 * | 10/2010 | Watanabe | 381/394 |
| 2004/0081325 | A1 * | 4/2004 | Rautio et al. | 381/189 |
| 2006/0038733 | A1 * | 2/2006 | Wedel et al. | 343/795 |
| 2006/0094378 | A1 * | 5/2006 | Murray et al. | 455/128 |

* cited by examiner

*Primary Examiner* — Davetta W Goins
*Assistant Examiner* — Amir Etesam
(74) *Attorney, Agent, or Firm* — Cha & Reiter, LLC.

(57) ABSTRACT

Provided is a speaker module for a portable terminal which e includes a speaker housing having an opened front surface thus defining a resonance space, a radiation pattern disposed on a back surface of the speaker housing, and connection terminals which extend from the radiation pattern to be disposed in the resonance space, such that the radiation pattern is disposed on the speaker housing and the connection terminal for providing electric connection of the radiation pattern is disposed in an inner side of the speaker housing.

16 Claims, 3 Drawing Sheets

SPEAKER MODULE FOR PORTABLE TERMINAL

CLAIM OF PRIORITY

This application claims the benefit under 35 U.S.C. §119 (a) of a Korean Patent Application filed in the Korean Intellectual Property Office on Jul. 30, 2012 and assigned Serial No. 10-2012-0083372, the entire disclosure of which is hereby incorporated by reference.

BACKGROUND

1. Field of the Invention

The present disclosure generally relates to an audio device, and more particularly, to a speaker module mounted on a portable terminal.

2. Description of the Related Art

A speaker module is typically provided in various audio or video devices, such as a wireless or a mobile terminal, for outing a sound. A function of the mobile communication terminal has evolved from voice and data communication to various functions such as a portable game console. Now, a multimedia player and other devices have been integrated into a single mobile communication terminal To provide a multimedia function on a portable terminal, a larger display device is needed and at the same time, to maintain portability, miniaturization of the portable terminal is also required. To this end, a touch screen with a virtual key pad is implemented as display unit, so that the display device is expanded but the thickness of the portable terminal is reduced.

The sound quality of the speaker module varies depending on a volume of the speaker module. That is, as the volume of the speaker module increases, the speaker module generally outputs a sound which is rich and near the original sound. However, there is a limitation in securing a sufficient volume of the speaker module as the speaker module is mounted in a miniaturized and thin-shaped portable device. Moreover, there is a need to mount communication antennas of different standards such as a wireless Local Area Network (LAN), Bluetooth, Near Field Communication (NFC), and so forth inside the portable terminal Therefore, a need for efficient use of an inner space of the miniaturized and thin-shaped portable terminal is urgent. As an approach to efficiently use the inner space of the portable terminal, some antenna devices may be integrated into the speaker module.

FIGS. 1 and 2 illustrate a conventional speaker module 10 in which some of antenna devices are integrated. As shown, the conventional speaker module 10 receives a speaker unit 21 in a speaker housing 11, and has a radiation pattern 15 on its circumferential surface. The speaker unit 21 receives a vibration layer, a magnetic object, a coil, a yoke, and so forth, and substantially generates a sound according to an applied electric signal. The radiation pattern 15 which is formed on an outer circumferential surface of the speaker housing 11, more specifically, a back surface of the speaker housing 11, is used as a portion of the antenna device. A front surface of the speaker housing 11 is opened, and an inner side of the speaker housing 11 is used as a resonance space 13 and a portion thereof is used as a space for receiving the speaker unit 21. The speaker unit 21 includes a flexible Printed Circuit Board (PCB) 23 which extends to a side of the speaker unit 21 and connection pads 25 which are provided on the flexible PCB 23. The speaker housing 11 is mounted such that the front surface of the speaker housing 11 confronts a circuit board (not shown) of the portable terminal, in which the connection pads 25 contact a sound signal connection terminal provided on the circuit board.

Further, between the circuit board and the speaker housing 11 is a sealing member 19 such as a poron tape interposed. The sealing member 19 is disposed on a front edge of the speaker housing 11, more specifically, a circumference of the resonance space 13. Hence, the resonance space 13 is completed substantially by coupling the speaker housing 11 with the circuit board, and the sealing member 19 prevents sound pressure from leaking in an unnecessary direction. To output a sound of the resonance space 13, sound output holes may be provided in a region corresponding to the resonance space 13 in the circuit board.

The radiation pattern 15 includes connection terminals 17 provided on an end thereof, which extend to partially cover the edge of the speaker housing 11 and thus to be positioned on the front surface of the speaker housing 11. The connection terminals 17 are positioned at a side of the resonance space 13 and on the front surface of the speaker housing 11. Once the speaker housing 11 is mounted on the circuit board, the connection terminals 17 contact a wireless signal connection pad provided on the circuit board.

The speaker module structured as described above provides the resonance space using the speaker housing and uses the speaker housing as a carrier for disposing an antenna radiation pattern, thus allowing efficient use of the inner space of the portable terminal.

However, only some volume of the speaker housing may be used to dispose the connection terminals for electrically connecting the radiation pattern to the circuit board, thereby resulting in a limitation in using the volume of the speaker housing as the resonance space. That is, as shown in FIG. 1, only 60-70% of the actual volume of the speaker housing is used as the resonance space.

SUMMARY

Accordingly, the present invention provides a speaker module capable of improving sound quality of a miniaturized and thin-shaped device such as a portable terminal by making the utmost use of a volume of a speaker housing as a resonance space.

The present invention also provides a speaker module capable of securing a sufficient resonance space in spite of having mounted therein a radiation pattern of an antenna device.

The present invention also provides a speaker module capable of implementing a stable connection structure for a radiation pattern disposed in a speaker housing while maximizing the space of a speaker housing in a portable terminal as a resonance space.

Moreover, the present invention also provides a speaker module which allows efficient use of an inner space of a portable terminal by having mounted therein a radiation pattern of an antenna device.

According to an aspect of the present invention, a speaker module for a portable terminal includes a speaker housing having an opened front surface, defining a resonance space, a radiation pattern disposed on a back surface of the speaker housing, and connection terminals which extend from the radiation pattern to be disposed in the resonance space.

The speaker module may further include a through-opening formed in the speaker housing and a sealing member attached to the speaker housing to close the through-hole, in which the connection terminals extend from the radiation pattern to be disposed in an inner side of the resonance space through the through-hole.

BRIEF DESCRIPTION OF THE DRAWINGS

The above and other features and advantages of an exemplary embodiment of the present invention will be more apparent from the following detailed description taken in conjunction with the accompanying drawings, in which.

DETAILED DESCRIPTION

Hereinafter, an embodiment of the present invention will be described with reference to the accompanying drawings. For the purposes of simplicity and clarity, a detailed description of well-known functions and constructions will not be provided as they unnecessarily obscure the subject matter of the present invention.

Figure 3:
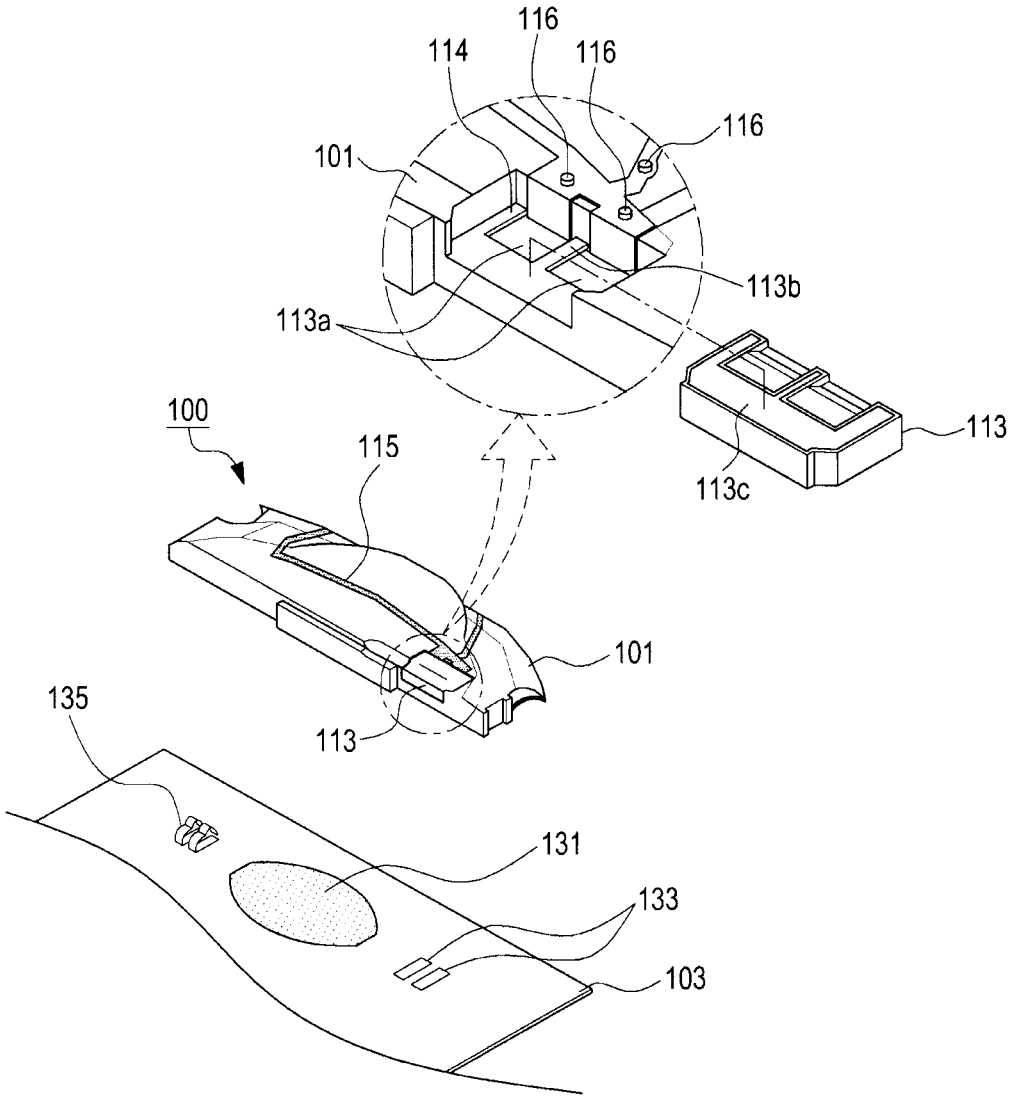
FIG. 3 is a perspective view showing a speaker module according to an embodiment of the present invention.
Figure 4:
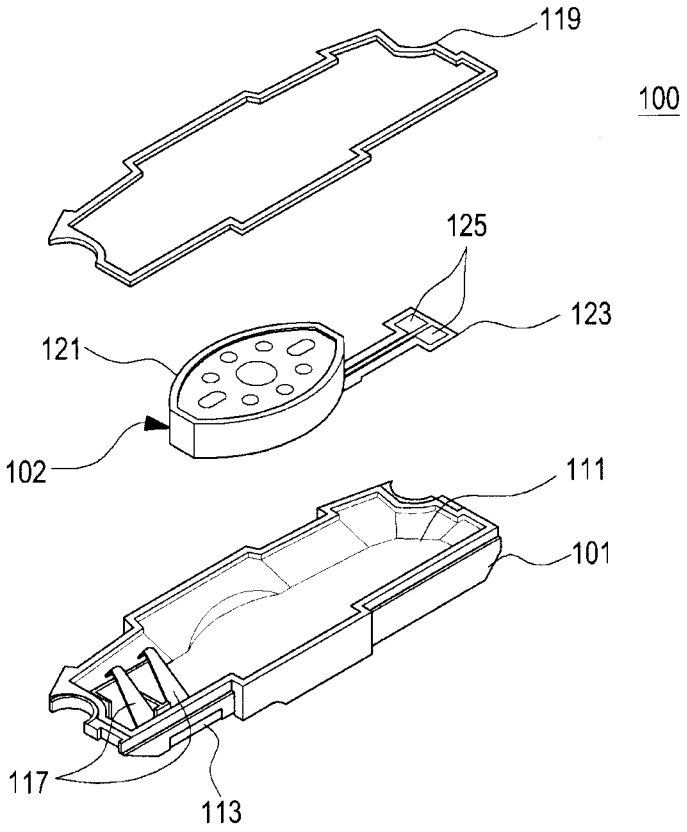
FIG. 4 is an exploded perspective view illustrating a speaker module illustrated in FIG. 3.
Figure 5:
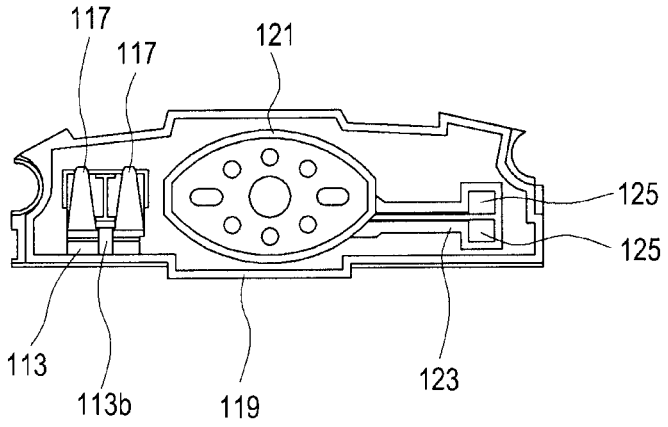
FIG. 5 is a floor plan illustrating a speaker module illustrated in FIG. 4.

FIGS. 3 through 5 illustrate a speaker module 100 according to an embodiment of the present invention. As illustrated in FIGS. 3 through 5, in the speaker module 100 according to an embodiment of the present invention, a radiation pattern 115 forming a portion of an antenna device is disposed in a speaker housing 101 and connection terminals 117 which provide electric connection of the radiation pattern 115 are disposed in an inner space of the speaker housing 101, more specifically, in a resonance space 111.

The speaker housing 101 provides the resonance space 111 whose front surface is opened, and includes a through-hole 113*a* which is formed to penetrate a back surface of the speaker housing 101 from the resonance space 111. In the resonance space 111 is disposed a speaker unit 102 which includes a main body 121 for receiving a magnet, a coil, a vibration plate, a yoke, or the like and a Flexible Printed Circuit Board (FPCB) 123 which extends laterally from the main body 121. On the FPCB 123 are installed connection pads 125 through which a sound signal is applied, such that the vibration plate is vibrated by an electromagnetic force of the coil and the magnet received in the main body 121 according to the applied sound signal, thus generating a sound. When the speaker unit 102 is disposed and fixed in the resonance space 111, the FPCB 123 is fixed at a side of the main body 121 in the resonance space 111. The connection pads 125 are disposed toward the front surface of the speaker housing 101.

The speaker unit 102 is preferably disposed in a generally sealed space in other portions except for a sound output hole for outputting a sound. The speaker housing 101 which receives the speaker unit 102, in other words, the resonance space 111 has an opened front surface. The speaker housing 101 is coupled such that the opened front surface thereof confronts a circuit board 103 of the portable terminal, thereby allowing the resonance space 111 to have a sealed structure. Although it is mentioned that the resonance space 111 has the sealed structure, it should be noted that the resonance space 111 communicates with outside through the sound output hole/opening for outputting a sound as stated above. The sound output hole is formed on the circuit board 103 which is coupled with the speaker housing 101 in such a way to confront the speaker housing 101. A region 131 of the circuit board 103 directly confronts the resonance space 111, and a plurality of sound output holes may be formed in the region 131 of the circuit board 103 which directly confronts the resonance space 111.

To prevent the sound pressure of a sound generated from the speaker module 100 from leaking to other portions except for the sound output hole, especially, between the speaker housing 101 and the circuit board 103, the speaker module 100 may include a first sealing member 119. The first sealing member 119 is disposed on the edge of the front surface of the speaker housing 101 to enclose the opened surface of the resonance space 111. The first sealing member 119 is preferably manufactured of a material such as a poron tape. Thus, a sound generated from the speaker module 100 is output only through the sound output hole(s).

Meanwhile, the connection pads 125 of the FPCB 123 are coupled to a sound signal connection terminal 135 disposed on the circuit board 103. The sound signal connection terminal 135 may be a C-clip having a leaf spring structure. The sound signal connection terminal 135 is disposed at a side of the sound output hole to correspond to the connection pads 125 disposed on the FPCB 123. Hence, when the speaker housing 101 is coupled to the circuit board 103, the connection pads 125 contact the sound signal connection terminal 135, thus being electrically coupled to the sound signal connection terminal 135.

The radiation pattern 115 serves to transmit and receive a wireless signal, and is disposed on the outer circumferential surface, that is, the back surface, of the speaker housing 101. The radiation pattern 115 is formed by cutting out a metallic thin plate and mounting and fixing the metallic thin plate on the outer circumferential surface of the speaker housing 101. On the outer circumferential surface of the speaker housing 101, fusion protrusions 116 may be formed at predetermined intervals in a region where the radiation pattern 115 is disposed. The fusion protrusions 116 protrude in such a way to penetrate the metallic thin plate forming the radiation pattern 115, and when the radiation pattern 115 is disposed, protruding portions of the fusion protrusions 116 are fused, thereby fixing the radiation pattern 115 on the outer circumferential surface of the speaker housing 101.

In a detailed embodiment of the present invention, the radiation pattern 115 is formed by cutting out the metallic thin plate, but it may also be formed by plating, etching, or the like. That is, a metallic material is plated onto the outer circumferential surface of the speaker housing 101, and then the metallic material in other portions except for the designed radiation pattern 115 may be removed through etching or the like. In this way, formation and disposition of the radiation pattern 115 may be properly selected considering the efficiency and cost of a manufacturing process, and so forth.

The connection terminals 117 which electrically connect the radiation pattern 115 to the circuit board 103 extend from one end of the radiation pattern 115 to an inner side of the resonance space 111 through the through-hole 113*a*. The connection terminals 117 have a leaf spring structure, thus being stably connected to the circuit board 103. When the radiation pattern 115 is formed by cutting out the metallic thin plate, the connection terminals 117 may also be formed of a portion of the metallic thin plate which is used to form the radiation pattern 115. That is, when the radiation pattern 115 is formed of the metallic thin plate, the connection terminals 117 may be formed integrally with the radiation pattern 115.

On the circuit board 103, wireless signal connection pads 133 are disposed at a side of the sound output hole, and the connection terminals 117 respectively contact the wireless signal connection pads 133. Thus, the radiation pattern 115 is electrically connected to a communication circuit provided on the circuit board 103 or the ground. The connection terminals 117 are preferably disposed at the other side of the main body 121 of the speaker unit 102 in the resonance space 111. In other words, the connection terminals 117 and the FPCB 123 of the speaker unit 102 are disposed in different spaces with the main body 121 therebetween.

As mentioned before, it is desirable to prevent the sound pressure of the speaker module 100 from being output to other portions except for the sound output hole. Considering prevention of the unnecessary leakage of the sound pressure, it is also desirable to seal the through-hole 113*a*. Therefore, the speaker module 100 according to the present invention includes another sealing member 113 which seals the through-hole 113*a*. To distinguish the sealing member 113 from the first sealing member 119 disposed between the circuit board 103 and the speaker housing 101, the sealing member 113 for sealing the through-hole 113*a* will be referred to as a second sealing member 113 hereinafter.

The second sealing member 113 is attached onto the through-hole 113*a* on the outer circumferential surface of the speaker housing 101. The second sealing member 113 is attached onto the speaker housing 101 by means of a both-side tape 113*c* or the like. To stably attach and fix the second sealing member 113, a support rib 113*b* may be formed on the speaker housing 101. The support rib 113*b* is formed to traverse the through-hole 113*a* and a portion of the second sealing member 113 is attached onto the support rib 113*b*. That is, by forming the support rib 113*b*, a larger area for attaching the second sealing member 113 may be secured. Since the support rib 113*b* is formed to traverse the through-hole 113*a*, the connection terminals 117 are preferably disposed at both sides of the support rib 113*b*.

On the outer circumferential surface of the speaker housing 101, a receiving recess 114 for receiving the second sealing member 113 is formed on the through-hole 113*a*. The second sealing member 113 is completely received in the receiving recess 114 and thus does not protrude from the outer circumferential surface of the speaker housing 101. The second sealing member 113 closely contacts the inner wall of the receiving recess 114, thus entirely sealing the through-hole 113*a*. To form such a sealing structure, the second sealing member 113 is preferably formed of an elastic material, for example, a rubber material. However, depending on an embodiment, the second sealing member 113 may also be formed of a material such as poron, an injection material, a nonwoven material, or the like.

According to the above configuration, the speaker module 100 may provide a stable connection structure of the radiation pattern 115 while using the most volume, nearly 100% of the volume of the speaker housing 101, as the resonance space 111.

Figure 1:
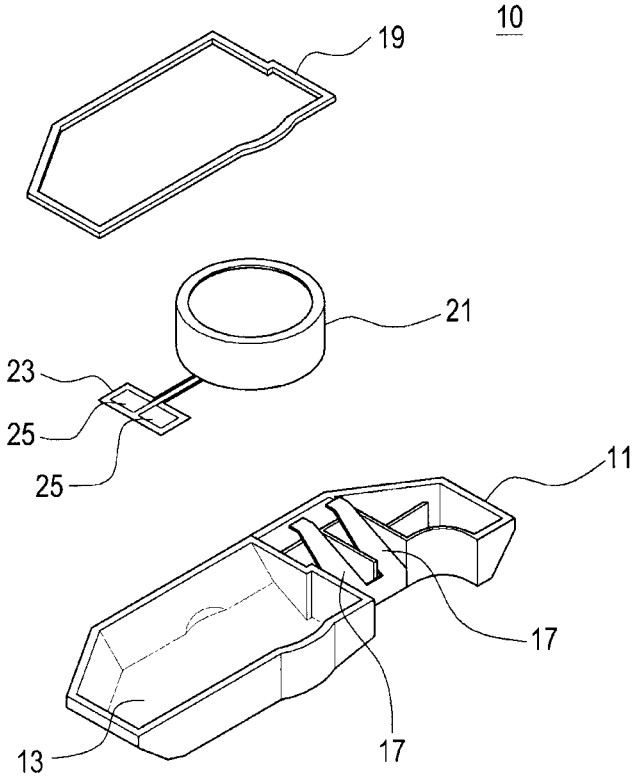
FIG.1 (PRIOR ART)
FIG. 1 is an exploded perspective view illustrating a speaker module according to a conventional embodiment of the present invention.
Figure 2:
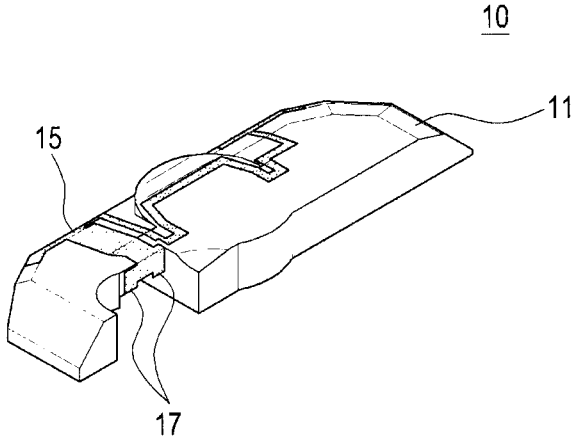
FIG.2 (PRIOR ART)
FIG. 2 is a perspective view showing a state in which an antenna device is integrated into a speaker module illustrated in FIG. 1.

In the speaker module 100 according to the present invention, when compared to in the conventional speaker module 10 illustrated in FIG. 1, the size of the speaker unit 102 can be larger. In the conventional speaker module 10, the size of the speaker unit 21 is restricted due to a barrier which divides a space for disposing the connection terminals 17 and the resonance space 13. On the other hand, in the speaker module 100 according to the present invention, the most of the speaker housing volume 101 is used as the resonance space 111 on which the speaker unit 102 may be disposed, such that the main body 121 of the speaker unit 102 may be formed in an oval shape. Thus, assuming that the same volume of the speaker housing 101 is used, the speaker module 100 according to the present invention may have mounted thereon the speaker unit 102 having a larger diameter than the conventional speaker module 10, thereby improving the output of the speaker unit 102. Moreover, even when having mounted thereon the speaker unit 102 having the same diameter as the conventional speaker module 10, the speaker module 100 according to the present invention may secure the larger resonance space 111, thus being favorable to improvement of the sound quality.

The speaker module structured as described above is structured such that the radiation pattern is disposed on the speaker housing and the connection terminal for providing electric connection of the radiation pattern is disposed in an inner side of the speaker housing, that is, the resonance space, thereby using nearly 100% of the volume of the speaker housing as the resonance space and thus contributing to providing the best sound quality which is allowed in a limited space of a miniaturized and thin-shaped device such as a portable terminal Moreover, by integrally forming the radiation pattern and the connection terminals, the stable connection structure of the radiation pattern may be implemented and the speaker housing of the speaker module is used as a carrier on which the radiation pattern is mounted, thereby efficiently using the inner space of the portable terminal.

While the present invention has been particularly illustrated and described with reference to the exemplary embodiment thereof, various modifications or changes can be made without departing from the scope of the present invention. Therefore, the scope of the present invention is not limited to the disclosed embodiment, and it should be defined by the scope of the following claims and equivalents thereof.

What is claimed is:

1. A speaker module for a portable terminal, the speaker module comprising:

a speaker housing having an opened front surface for providing a resonance space;

a radiation pattern disposed on a back surface of the speaker housing and configured to transmit and receive a wireless signal; and a plurality of connection terminals which extend from the radiation pattern to be disposed in the resonance space, wherein the plurality of connection terminals are integrally formed with the radiation pattern, and a circuit board having a plurality of sound output openings facing the resonance space, and a sealing member attached along an edge of a front surface of the speaker housing, wherein the speaking housing coupled to the circuit board via the sealing member.

2. The speaker module of claim 1, wherein the speaker housing further having a through-opening formed thereof; and another sealing member attached to the speaker housing to close the through-opening, wherein the plurality of connection terminals extend from the radiation pattern to be disposed in an inner side of the resonance space through the through-opening.

3. The speaker module of claim 2, wherein the another sealing member is formed of any one of rubber, an injection material, and a nonwoven material.

4. The speaker module of claim 2, wherein the speaker housing further includes a receiving recess on the outer circumferential surface of the speaker housing for receiving the another sealing member formed on the through-opening.

5. The speaker module of claim 4, wherein the another sealing member is completely received in the receiving recess and does not protrude from the outer circumferential surface of the speaker housing.

6. The speaker module of claim 1, the speaker housing further includes a through-opening formed to penetrate a back surface of the speaker housing from the resonance space.

7. The speaker module of claim 2, further comprising:

a support rib formed to traverse the through-opening, wherein a portion of the another sealing member is attached to the support rib.

8. The speaker module of claim 7, wherein the plurality of connection terminals are disposed at both sides of the support rib.

9. The speaker module of claim 1, wherein the radiation pattern and the connection terminals are formed integrally as one piece.

10. The speaker module of claim 1, wherein the sealing member is attached onto the speaker housing by means of a both-side tape.

11. The speaker module of claim 1, further comprising a speaker unit disposed in an inside center portion of the resonance space, wherein the plurality of connection terminals are disposed at a side of the speaker unit in the resonance space.

12. The speaker module of claim 11, wherein the speaker unit comprises:

a Flexible Printed Circuit Board (FPCB) which extends to the other side of a main body of the speaker unit in the resonance space; and connection pads disposed on the FPCB.

13. The speaker module of claim 11, wherein the speaker unit comprises an oval shape.

14. The speaker module of claim 11, wherein the speaker unit further comprises a main body for receiving one of a magnet, a coil, a vibration plate and a yoke.

15. The speaker module of claim 1, wherein the sealing member comprises a tape.

16. The speaker module of claim 1, wherein a sound generated from a speaker unit disposed in the speaker housing is output only through the plurality of sound output openings.

* * * * *